United States Patent [19]

Follows

[11] 4,432,523

[45] Feb. 21, 1984

[54] CABINET SHELF SUPPORT BRACKET

[75] Inventor: James S. Follows, Surrey, Canada

[73] Assignee: Vanguard Plastics Ltd., Surrey, Canada

[21] Appl. No.: 364,494

[22] Filed: Apr. 1, 1982

[51] Int. Cl.[3] ..... A47G 29/02

[52] U.S. Cl. ..... 248/250; 108/110

[58] Field of Search ..... 248/243, 246, 235, 239, 248/241, 245, 247, 250; 108/107, 108, 110; 211/193, 187

[56] References Cited

U.S. PATENT DOCUMENTS

| | | | |
|---|---|---|---|
| Re. 22,544 | 9/1944 | Tinnerman | 248/241 |
| 1,829,009 | 10/1931 | Madsen . | |
| 2,610,012 | 9/1952 | Mackey et al. | 248/27.3 |
| 2,667,200 | 1/1954 | Bedford | 248/27.3 X |
| 3,471,111 | 10/1969 | MacDonald . | |
| 3,471,112 | 10/1969 | MacDonald et al. . | |
| 3,731,260 | 5/1973 | Nardone | 248/29.3 X |
| 4,037,813 | 7/1977 | Loui et al. . | |
| 4,053,132 | 10/1977 | Del Pozzo . | |
| 4,253,629 | 3/1981 | Wilmes | 248/68 R |

*Primary Examiner*—J. Franklin Foss

*Attorney, Agent, or Firm*—Christensen, O'Connor, Johnson & Kindness

[57] ABSTRACT

A shelf support bracket for supporting a shelf in a cabinet of the type having a plurality of shelves, the vertical positioning of which is effected by movement of the shelf support brackets, includes a backplate adapted for mounting against a sidewall of said cabinet, the sidewall of the cabinet and the shelf support bracket being constructed and arranged for removably mounting the shelf support bracket on the cabinet sidewall. A shelf support plate projects from a first surface of the backplate and is adapted to receive an edge portion of a shelf. A shelf-retaining structure is affixed to the backplate in a position spaced from the shelf support plate and cooperates therewith to retain the shelf edge portion on the support plate. The retaining structure includes a first portion lying substantially in the plane of the backplate and at least one planar ear portion contiguous with the first portion and extending therefrom obliquely to the plane of the backplate in a substantially upright orientation, the ear portion being resiliently yieldable to permit movement of the ear portion toward the plane of the backplate to permit passage of the shelf edge portion onto the shelf support plate whereupon the ear portion returns to its original position and overlies the shelf edge portion. The shelf edge portion is therefore intermediate the bottom edge of the ear portion and the upper surface of the support plate when positioned on the shelf support bracket.

7 Claims, 3 Drawing Figures

CABINET SHELF SUPPORT BRACKET

BACKGROUND OF THE INVENTION

This invention relates to shelf supports of the type primarily intended for supporting shelves between opposed upright members, for instance, cabinet sidewalls or walls at the ends of bookcases. In particular, the invention relates to a shelf support bracket that includes a retaining means to hold the shelf in place during movement of the cabinet or bookcase.

Brackets for supporting shelves inside cabinets and bookcases and permitting the spacing between adjacent shelves to be readily adjusted have been known for some time. Such a shelf support bracket is shown in U.S. Pat. No. 1,829,009 issued to Madsen. The shipping of cabinets having internal shelves has historically presented a problem. Thus, with shelf supports that did not also positively retain the shelf in place, the jostling that the cabinets received during shipment could cause the shelf to bounce around within the cabinet with consequent damage, both to the cabinet structure and to the shelf. Shelf brackets having a retaining means to maintain the shelf in position during movement of the cabinet have been proposed as shown, for example, in U.S. Pat. No. 3,471,112 to MacDonald et al. When any retaining mechanism is used, it is necessary to design such a mechanism for convenient removal of the shelf, as well as installation of the shelf, since the major advantage to movable shelf brackets is the ready adjustability of spacing between adjacent shelves.

It is therefore an object of the present invention to provide a shelf support bracket removably mountable in a wall of a cabinet or bookcase for easy adjustability of the spacing between adjacent shelves that also retains the shelves in position during movement of the cabinet.

It is a further object of this invention to provide such a shelf support bracket that allows relatively easy removal of the shelf as well as easy installation of the shelf on the bracket.

It is another object of this invention to provide such a shelf support bracket and retaining means that uses a minimum of material and is relatively economical to construct but that is also relatively pleasing in appearance.

SUMMARY OF THE INVENTION

In accordance with the above-stated objects, a shelf support bracket is provided that includes a backplate and a means for removably mounting the backplate on a cabinet wall. A shelf support plate projects from a first surface of the backplate and is adapted to receive an edge portion of a shelf. A shelf-retaining means is affixed to the backplate and spaced from the shelf support plate a distance at least equal to the shelf thickness. The shelf-retaining means is constructed and arranged to cooperate with the shelf support plate to retain the shelf edge portion on the support plate. The retaining means includes a first portion that lies in substantially the plane of the backplate and at least one ear portion contiguous with the first portion and extending therefrom in a substantially upright plane oblique to the plane of the backplate. The ear portion is resiliently yieldable in a direction toward the backplate to permit passage of the shelf edge portion toward the shelf support plate. Upon passage of the shelf edge portion of the ear portion returns to its position overlying the shelf portion. The shelf edge portion is therefore sandwiched intermediate the ear portion and the support plate. When it is desired to remove the shelf, the ear portion is again bent toward the first surface of the back plate to allow passage of the shelf edge portions away from the shelf portion plate.

Preferably, the ear portion is divergently tapered in a direction toward the shelf support plate to better cooperate with the shelf edge portion and permit the shelf edge portion to force the ear portion in a direction toward the backplate.

In a preferred embodiment of the shelf support bracket of the present invention a second planar ear portion is provided extending contiguously from the first portion and arranged obliquely to the plane of the backplate in such a manner that the first and second ear portions diverge as they extend from the first portion, the second ear portion being tapered in a manner identical to the first ear portion.

BRIEF DESCRIPTION OF THE DRAWINGS

The objects and advantages of the present invention will be more apparent to those of ordinary skill in the art and others upon reading the ensuing specification taken in conjunction with the accompanying drawings wherein.

DETAILED DESCRIPTION OF THE PREFERRED EMBODIMENT

Figure 1:
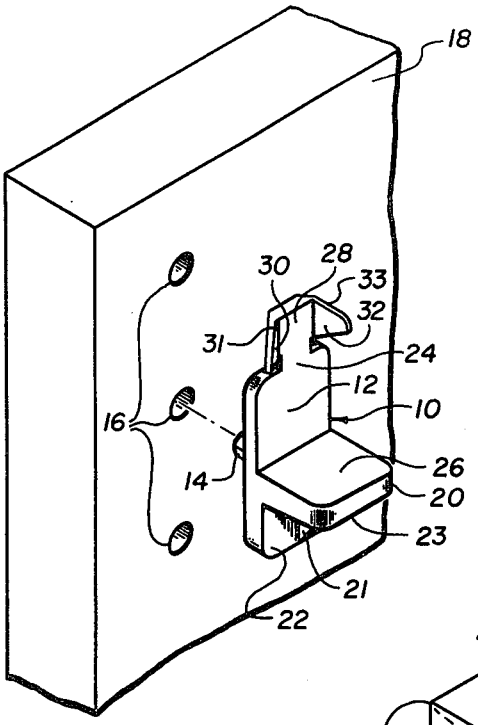
FIG. 1 is an isometric view of one embodiment of a shelf support bracket made in accordance with the principles of the present invention.

Referring to FIG. 1, one embodiment of a shelf support bracket 10 made in accordance with the present invention includes a substantially planar backplate 12 having a stem 14 projecting substantially orthogonally from a first surface of the backplate. The stem 14 is adapted to be received by a selected one of a plurality of holes 16 formed in a typical sidwall 18 of a cabinet or bookcase. The stem 14 typically is of a size and shape to provide an interference fit with the hole 16 so that shelf support bracket is securely but removably mounted on the cabinet sidewall 18.

A horizontal support plate 20 extends from a second surface 22 of the backplate 12 in a direction opposite the stem 14. A neck portion 24 extends upwardly from the top edge of the backplate 12 and is contiguous with the backplate. A retaining means is affixed to the neck portion 24 spaced from an upper surface 26 of the support plate 20 a distance approximately equal to the thickness of a shelf which is to be supported by the shelf support bracket 10.

The retaining means includes a back portion 28 coplanar with the backplate 12 and first and second ear portions 30 and 32, respectively, extending in an upright plane obliquely from the back portion 28 in the same direction as the support plate 20. The ear portions 30 and 32 diverge from one another as they extend from the back portion 28. The ear portions are substantially triangular in shape and each has a sloping forward edge, 31 and 33 respectively, which slopes downwardly as the ear extends from the back portion 28. The shelf support bracket is preferably a unitary piece molded from nylon, polyethylene, or some other plastic material that provides resiliency for the ear portions 30 and 32. A substantially triangular web portion 21 extends from a lower surface 23 of the shelf support plate 20 to the second surface 22 of the backplate 12 to provide additional structural strength to the support plate 20.

Figure 2:
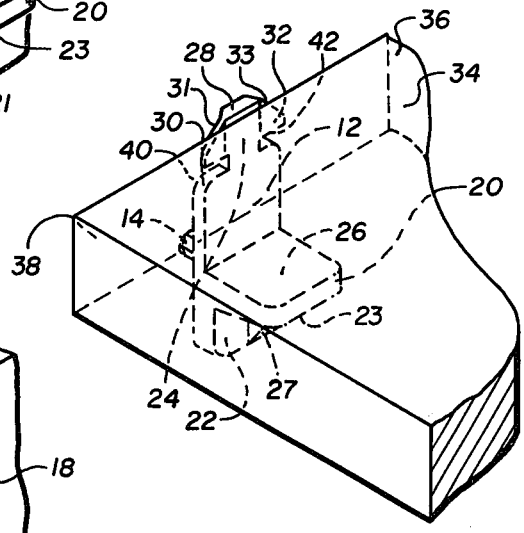
FIG. 2 is an isometric view of the shelf support bracket of FIG. 1 showing the positioning of a shelf as it is placed onto the bracket.
Figure 3:
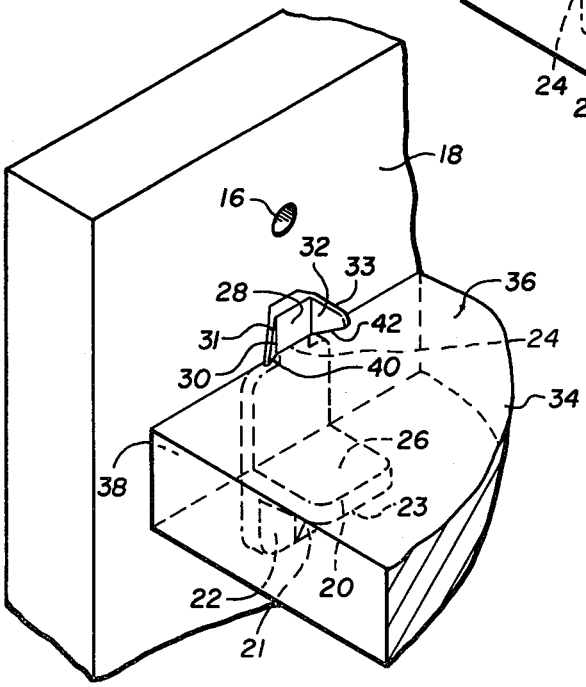
FIG. 3 is an isometric view of the shelf support bracket of FIG. 1 with a shelf installed thereupon.

Referring now to FIG. 2, a portion of typical shelf 34 is shown being installed on the shelf support bracket 10. FIG. 3 shows the shelf portion 34 in place on the shelf support bracket. It will be noted in FIG. 3 that when the shelf 34 is in place on the shelf support bracket 10, the ear portions 30 and 32 overlie an upper surface 36 of the shelf 34. In order to position the shelf on the shelf support bracket it is necessary to bend the ear portions 30 and 32 in a direction toward the cabinet sidewall 18 in order to allow the shelf to pass the ear portions and rest on the upper surface 26 of the support plate 20. As the shelf is being positioned on the shelf support bracket, a lower edge of the shelf rides down the downwardly sloping forward edges of the ear portions 30 and 32 and the end surface 38 of the shelf 34 forces the ear portions 30 and 32 toward the cabinet sidewall 18. The shelf support bracket is constructed so that bending of the ear portions 30 and 32 is within the elastic limit of the joint between the ear portions and the back portion so that, when the shelf has passed the ear portions and is positioned on the support plate 20, the ear portions 30 and 32 will snap back to their original orientation and overlie the upper surface 36 of the shelf 34 as shown in FIG. 3. Varying thickness of shelf material can be utilized simply by varying the spacing between the lower edges 40 and 42 of the ear portions 30 and 32 and the upper surface 26 of the support plate 20. The forwardmost corners of the ear portions 30 and 32 formed by the junction of the respective forward eges 31 and 33 with their associated lower edges 40 and 42 are preferably rounded to facilitate passage of the shelf 34 and reduce wear on the corner, which would occur if the corner were sharply pointed.

Typically four shelf support brackets are used to support each shelf in a cabinet or bookcase with one of the shelf support brackets being in proximity to each corner of the shelf. Such an arrangement provides stability to the shelf. The backplate 12 of the illustrated shelf support bracket 10 is slightly thicker below the support plate 20 than it is above the support plate 20 for increasing the structural strength of the shelf support bracket 10, thereby increasing the load support capacity of the shelf bracket. It will be obvious to those of ordinary skill in the art and others that the shelf bracket can be constructed with the backplate of a uniform thickness. Also, the spacing of the ears 30 and 32 from one another can vary as well as the size of the ears and the extent of their protrusion from the back portion 28. The overall size and spacings of the portions of the shelf support bracket can be varied depending on the thickness of shelf material being utilized, the lengths of shelves that the brackets are intended to support, and the weight of materials to be placed on those shelves and consequently the weight to be borne by the shelf support brackets. It will be understood by those of ordinary skill in the art and others that the abovementioned variations in construction of the shelf support bracket as well as others can be made while remaining within the scope of the present invention. The present invention is therefore to be defined solely with reference to the appended claims.

The embodiments of the invention in which an exclusive property or privilege is claimed are defined as follows:

1. In a cabinet of the type having at least one shelf, the vertical positioning of said shelf being variable and effected through the movement of shelf supports, a shelf support bracket comprising:

a backplate adapted for placement against one surface of a sidewall of said cabinet, said backplate having an upper portion of uniform thickness in a direction orthogonal to said sidewall;

a bracket-mounting means associated with said backplate for removably mounting said backplate to said sidewall;

a shelf support plate projecting from a first surface of said backplate such that said upper portion of said backplate lies above said shelf support plate, said shelf support plate constructed and arranged to receive an edge portion of said shelf;

a shelf-retaining means extending from said upper portion of said backplate, spaced from said shelf support plate and constructed and arranged to cooperate therewith to retain said shelf edge portion on said support plate, said shelf-retaining means including a first portion substantially coplanar with said upper portion of said backplate and of a thickness no greater than the thickness of said upper portion of said backplate and, at least one planar ear portion contiguous with said first portion and extending from a first edge thereof in a substantially upright plane oblique to the plane of said first portion, said ear portion resiliently yieldable to a position in which the surfaces of said upper portion, first portion and ear portion that are distally located from said sidewall and are adapted to contact said edge portion of said shelf are coplanar to permit passage of said shelf edge whereupon said ear portion returns to its original position and overlies said shelf edge portion, said shelf edge portion when in place upon said shelf support bracket lying intermediate said ear portion and said support plate.

2. The shelf support bracket of claim 1 wherein said shelf-retaining means further includes a second planar ear portion identical to said first ear portion and contiguous with and extending obliquely from a second edge of said first portion, said first and second ear portions diverging from one another as they extend from said first portion.

3. The shelf support bracket of claim 2 wherein each of said ear portions includes an upper edge portion that slopes downwardly as it extends from said first portion and a bottom edge lying in a plane substantially parallel to said shelf support plate, the distal ends of said bottom edge and upper edge portions of said ears meeting to form a forward corner.

4. The shelf support bracket of claim 3 wherein said forward corner of each of said ear portions is rounded, said sloping upper edge portion and said rounded forward corner of each ear constructed and arranged so as to assist the movement of an edge portion of said shelf downwardly into position upon said shelf support plate.

5. The shelf support bracket of claim 1, 2 or 3 wherein said shelf support bracket mounting means comprises a stem extending substantially orthogonally from a second surface of said backplate adapted to be received within a hole formed in said cabinet sidewall.

6. The shelf support bracket of claim 5 wherein said stem is of a size sufficient to form an interference fit with said hole in said sidwewall such that said shelf support bracket can be snugly yet removably mounted on said sidewall.

7. The shelf support bracket of claim 6 wherein said shelf support bracket is integrally formed of a unitary piece of nylon.

* * * * *